United States Patent [19]

Matsui

[11] 4,128,328

[45] Dec. 5, 1978

[54] DEVELOPING ELECTRODE TYPE ELECTROSTATIC COPYING MACHINES

[75] Inventor: Toshio Matsui, Toyokawa, Japan

[73] Assignee: Minolta Camera Kabushiki Kaisha, Osaka, Japan

[21] Appl. No.: 689,846

[22] Filed: May 25, 1976

[30] Foreign Application Priority Data

May 28, 1975 [JP] Japan ..... 50-64536
Nov. 5, 1975 [JP] Japan ..... 50-133435

[51] Int. Cl.[2] ..... G03G 15/00; B05B 5/02

[52] U.S. Cl. ..... 355/3 DD; 118/651; 118/657; 271/193; 355/3 SH

[58] Field of Search ..... 355/3 DD, 10, 3 SH, 355/3 TE, 3 R; 118/647, 651, 657; 271/193

[56] References Cited

U.S. PATENT DOCUMENTS

| | | | |
|---|---|---|---|
| 3,323,794 | 6/1967 | Brandt | 271/193 |
| 3,684,363 | 8/1972 | Ito et al. | 355/3 R |
| 3,689,144 | 9/1972 | Kaufman | 355/3 DD |
| 3,749,059 | 7/1973 | Sato | 355/10 |
| 3,870,017 | 3/1975 | Kratcoski et al. | 355/3 DD |
| 3,941,469 | 3/1976 | Okamoto | 355/3 DD |
| 3,981,498 | 9/1976 | Fletcher | 271/193 |

*Primary Examiner*—Fred L. Braun
*Attorney, Agent, or Firm*—Watson, Cole, Grindle & Watson

[57] ABSTRACT

An electrostatic copying machine uses a copy sheet having a dielectric layer or photoconductive layer overlaying an electrically conductive layer, and includes image forming structure for forming an electrostatic latent image on the copy sheet, a developer for developing the electrostatic latent image on the copy sheet in the form of a toner image according to the developing electrode method, and a fixer for fixing the toner image on the copy sheet. The developing electrodes are electrically connected to each other but insulated from the body proper of the copying machine. The copy-sheet-transporting passage between the developing electrodes and voltage-impressing structure, which impresses a voltage on the electrically conducting layer of the copy sheet, is of a length shorter than that of the copy sheet. The voltage impressing structure may be positioned at one or more of the electrostatic-latent-image-forming apparatus, fixer, or the transporter structure positioned between the developer and the fixer.

15 Claims, 5 Drawing Figures

DEVELOPING ELECTRODE TYPE ELECTROSTATIC COPYING MACHINES

BACKGROUND OF THE INVENTION

This invention relates to electrostatic copying machines using a copy sheet having an electrically conductive layer, such as for instance, to electrostatic transfer type copying machines, in which the electrostatic latent image that has been formed on a photoconductive drum is transferred onto a copy sheet having a dielectric layer overlaying its electrically conductive layer. The electrostatic latent image thus obtained is developed and fixed. The invention also relates to electrostatic copying machines in which the electrostatic latent image is directly formed on a copy sheet having a photoconductive layer overlaying its electrically conductive layer. The electrostatic latent image thus obtained is developed and fixed.

At the present time, there has arisen a demand for reducing the size of copying machines and improving the clearness of the images obtained. Also there is a need for speeding-up the copying operation, particularly the copying operation for a single copy sheet. To meet such demands, there have been proposed many arrangements which are intended to improve the image-forming elements such as the electrostatic-latent-image-forming devices, the developing devices, the fixing devices and so forth. Also the copy-sheet-transporting passages between the respective image-forming elements have been shortened. Particularly, it is essential to provide a transporting passage with a length shorter than that of the copy sheet, for achieving a reduced size of the copying machine and for speeding-up the copying operation.

Further, to achieve the desired improved clearness of the image, it is essential that the device for developing the electrostatic latent image on the copy sheet be of the developing-electrode type.

A fixing device using a heated drum contributes to a reduction in the size of the copying machine. In this connection, for achieving a rapid copying operation by using a heated drum, it is essential that the copy sheet be brought into intimate contact with the surface of the heated drum for ensuring a rapid fixing. That object is attained by uniformly charging the surface of the heated drum by a corona charger, so that the copy sheet is electrostatically attracted to the surface of the heated drum.

Moreover, in the case of a dry type electrostatic copying machine, after development the copy sheet retains an unfixed toner image, so that the means for transportation of the copy sheet to a fixing station and through the fixing device should be of a type, in which only one side of the copy sheet is utilized for transportation. For example, in electrically conductive layer of the copy sheet is utilized for transportation, unlike the transportation of the copy sheet up to the developing station where both sides of the copy sheet may be used in its conveyance. Thus, it has been general practice to use an endless belt transportation system, and the surface of a heated drum is commonly used as a transporting means through the fixing station. Accordingly, for ensuring the positive transportation of a copy sheet during rapid copying operation, it is mandatory that the copy sheet be positively attracted to the transporting means. To reduce the size of a copying machine, while achieving positive attraction and transportation of copy sheets, it is preferable to adopt an electrostatic attracting system using, for example, a corona discharge device.

Also, in the case of a dry type electrostatic copying machine, the improvements in the clearness of an image dictate the use of a developing-electrode type developing device, which uses a mono-component toner having magnetic properties and electrical conductivity, as is disclosed in U.S. Pat. No. 3,909,258, so that electrically conductive paths in the form of toner chains are formed between the electrostatic latent image surface of a copy sheet and the developing electrode.

Although the electrostatic copying machine of the type described is successful in reducing the size of a copying machine and in obtaining rapid copying operation according to respective improvements in the image-forming-elements and the lengths of the transporting passages, the machine still poses another unexpected problem with respect to the clearness of an image.

The problem observed by the inventor in electrostatic copying machines embodying in developing device of the conventional developing electrode type, is that, with the leading portion of the copy sheet having passed the developing station and reached the transporting belt to be fed in electrostatically attracted condition and the remainder of the copy sheet still within the developing station, upon passing through the developing station a uniform ground contamination is formed thereon by the adhesion of toner onto the area having no electrostatic latent image. Ground contamination also appears on the copy sheet after the leading portion thereof has reached the heated drum in an electrostatically attracted condition which accelerates the adhesion of toner to the copy sheet.

Furthermore, the inventor has found that in case the charging polarity of the corona charger is opposite to that of an electrostatic latent image on a copy sheet, the contrast of the developed image is further impaired. This is caused because, upon development of an electrostatic latent image on a copy sheet with the aid of electrically conductive paths in the form of toner chains between a developing electrode and the aforesaid latent image, the potentials which have been charged on the surface of the transporting belt as well as on the heated drum are impressed on the electrically conductive layer of the copy sheet, so that there is a potential difference between the developing electrodes and the copy sheet through the medium of the electrically conductive layer thereof. Thereby, electrically conductive paths in the form of toner chains are formed even in the non-image areas of the copy sheet, leading to the clinging of toner to the copy sheet.

Stain or contamination due to toner on the copy sheet will be described in more detail in conjunction with the description of FIG. 1. Copy sheet 10 which has dielectric layer 6 deposited on electrically conductive layer 7 receives thereon a negative electrostatic latent image. Developing electrodes 8*a*, 8*b* are grounded to the body proper of the copying machine (not shown). Voltage impressing means 9 for impressing a voltage on electrically conductive layer 7 of the copy sheet, consists of a corona charger for charging the surfaces of the transporting belt and the heated drum, and is grounded to the body proper of the copying machine. The description is made with a positive voltage impressed on electrically conductive layer 7 of copy sheet 10, and copy sheet 10 is moved in the direction of the arrow.

As will be apparent from the drawing, developing electrode 8a and voltage impressing means 9 are disposed so that an electrically conductive path is formed through the body proper of the copying machine and electrically conductive layer 7 of copy sheet 10. The potential of electrically conductive layer 7 of copy sheet 10 positioned between both developing electrodes 8a, 8b is raised to a positive electric potential as shown, the absolute value of which is higher than that of the reference potential. The positive electric potential thus raised produces a potential difference, i.e., an electric field, between electrically conductive layer 7 and developing electrode 8a. That electric field exerts a biasing action, i.e., an inverse biasing action in the example shown, on the developing electric field produced by the electrostatic latent image on the copy sheet. The electric field provides an electrically conductive path in the form of toner chains even in the area of the copy sheet from which an electrostatic latent image is absent. The electric field acts to weaken the developing electric field on the electrostatic-latent-image-formed-area of the copy sheet, the aforesaid developing electric field forming an electrically conductive path in the form of toner chains, thus adversely affecting the clearness of the reproduced image.

To solve the aforesaid problem, a grounding method has been proposed, in which, as is exemplified in FIG. 2, there is provided between developing electrodes 8a, 8b and voltage impressing means 9 a means 11 for removing or dissipating the electric potential from electrically conductive layer 7 of copy sheet 10. In other words, electrically conductive members grounded to the body proper of the copying machine are brought into contact with electrically conductive layer 7 of copy sheet 10, so as to lower the electric potential on electrically conductive layer 7 to the proximity of a reference electric potential. Such a grounding system, however, is not effective to lower the electric potential on electrically conductive layer 7 of copy sheet 10 to the proximity of the reference electric potential, because electrically conductive layer 7 has an electric resistance in the order of $10^6 - 10^9$ ohm, and also because there is an unstable contact between the copy sheet and the electrically conductive members. To lower the electric potential to the proximity of the reference potential successfully, an inverse biasing system has been proposed, in which electrically conductive members are sequentially disposed in contacting relation to electrically conductive layer 7 of copy sheet 10 between voltage impressing means 9 and developing electrodes 8a and 8b. In that manner one electrically conductive member impresses on electrically conductive layer 7 a bias voltage of a polarity opposite to that of voltage impressing means 9. The other electrically conductive member in succession thereto impresses on electrically conductive layer 7 a bias voltage having gradually reduced absolute values with a polarity opposite to that of the first electrically conductive member, so that the electric potential on electrically conductive layer 7 is lowered into close proximity to the reference potential immediately in front of developing electrodes 8a and 8b. Such an inverse biasing system is disclosed in U.S. Pat. No. 3,757,165.

The techniques as are taught in U.S. Pat. No. 3,757,165 are effective only for electrically conductive members, such as copy-sheet transporting rollers which are in complete intimate contact with the electrically conductive layer of the copy sheet.

Accordingly, for a copy sheet which retains unfixed toner after development, such transporting rollers for transporting the copy sheet prior to its development are not recommended in view of the tendency of toner to cling to the rollers. Additionally, the aforesaid one-side transportation utilizing the electrically conductive layer of the copy sheet does not ensure intimate contact between the copy sheet and the roller. For the above reasons, the above-described means for removing electric potential from the electrically conductive layer are not adapted for use in a copying machine.

The stain on the copy sheet is a problem to be solved in satisfying demands for reducing the copying machine size, improving clearness of the reproduced image and accelerating the copying operation.

SUMMARY OF THE INVENTION

It is accordingly an object of the present invention to provide an electrostatic copying machine with a reduced size, improved clearness of the reproduced image and which accelerates the copying operation, particularly the copying operation of a single copy sheet.

It is another object of the present invention to provide an electrostatic copying machine, which meets the above-described demands, without providing a means for removing bias electric potential which is formed on an electrically conductive layer of the copy sheet in the transporting passage between the image forming means and the developing device which is of the developing electrode type.

It is a further object of the present invention to provide an electrostatic copying machine of the type including a transporting passage shorter than a length of a copy sheet, the transporting passage being provided between a dry-type developing device of the developing electrode type and a device for fixing unfixed toner on the copy sheet, and with the copy sheet having an unfixed toner image being electrostatically attracted and transported, although such operation has been absolutely impossible in prior copying machines having bias potential removing means.

It is a still further object of the present invention to provide an electrostatic copying machine of the type including a transporting passage shorter than a length of a copy sheet, the transporting passage being provided between a dry-type developing device and a heated drum for fixing unfixed toner on the copy sheet, and the copying machine further including a high voltage impressed onto the heated drum, although such has been impossible with the bias-voltage removing means of the prior art.

To attain these objects, the present invention provides a copying machine including an improved developing device of the developing electrode type, in which the bias potential on an electrically conductive layer of a copy sheet exerts no influence on the developing electrodes. According to the present invention, the developing device is so arranged that, as is obvious from FIG. 3, developing electrode 8a and developing electrode 8b are positively electrically insulated from the body proper of the copying machine, but electrically connected to each other, thereby preventing formation of an electric circuit between the developing electrodes and the voltage impressing means 9. Also, the transporting passage from the developing device to the voltage impressing means is shorter than a length of a copy sheet. More specifically, an electrostatic copying machine according to the present invention uses a copy sheet having a dielectric layer or photoconductive layer deposited on an electrically conductive layer. The copying means further comprises means for forming an electrostatic latent image on the copy sheet; developing means for developing the electrostatic latent image on the copy sheet into a toner image using developing electrodes; and means for fixing the toner image on the copy sheet. Moreover, the developing electrodes are electrically connected to each other, but electrically insulated from the body proper of the copying machine. Finally, the transporting passage from the developing device to the voltage impressing means is shorter than a length of a copy sheet, and the voltage impressing means is provided for impressing a voltage on the electrically conductive layer of the copy sheet.

A charge potential may also be inadvertently placed on the electrically conductive layer of the copy sheet at the location of one or more of the electrostatic latent image forming means, fixing means, and the transporting means positioned between the developing means and the fixing means.

These and other objects and features of the present invention will be apparent from the ensuing specification in conjunction with the drawings which indicate a preferred embodiment of the present invention.

DESCRIPTION OF THE PREFERRED EMBODIMENT

Figure 1:
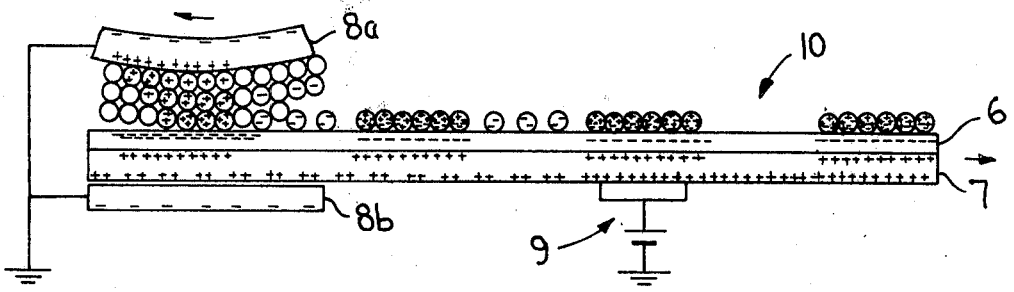
Fig.1 PRIOR ART
FIG. 1 is a view illustrating the principle of bias potential influence on an electrically conductive layer of a copy sheet, in a prior art developing device according to the developing electrode type system.
Figure 2:
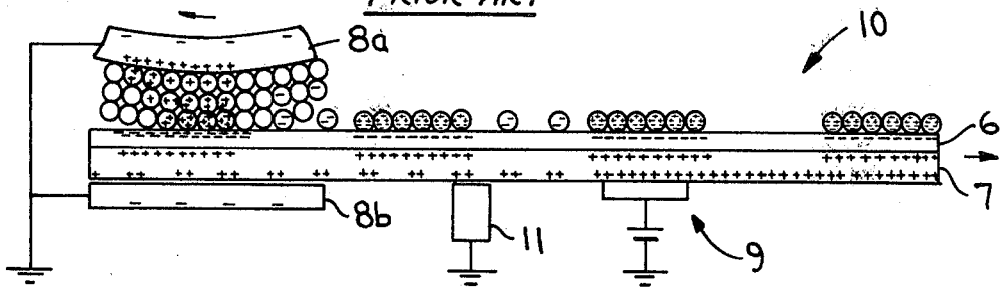
Fig.2 PRIOR ART
FIG. 2 is a view illustrative of the principle of the conventional means for removing bias potential from the electrically conductive layer in the developing device of FIG. 1.
Figure 3:
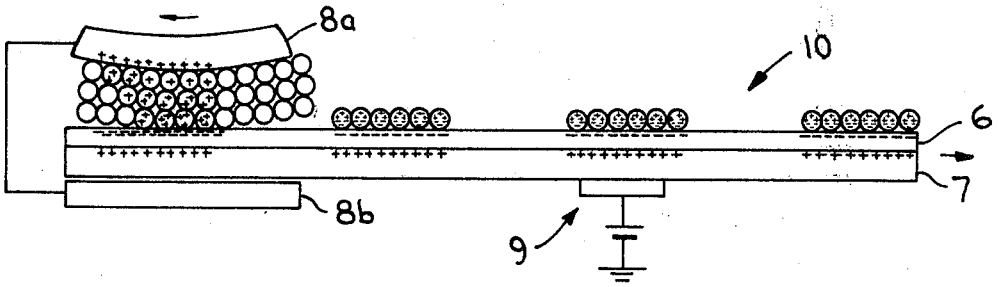
FIG. 3 is a view illustrative of the principle of a developing device according to the developing electrode type system, in which the bias potential exerts no influence on the developing electrodes.
Figure 4:
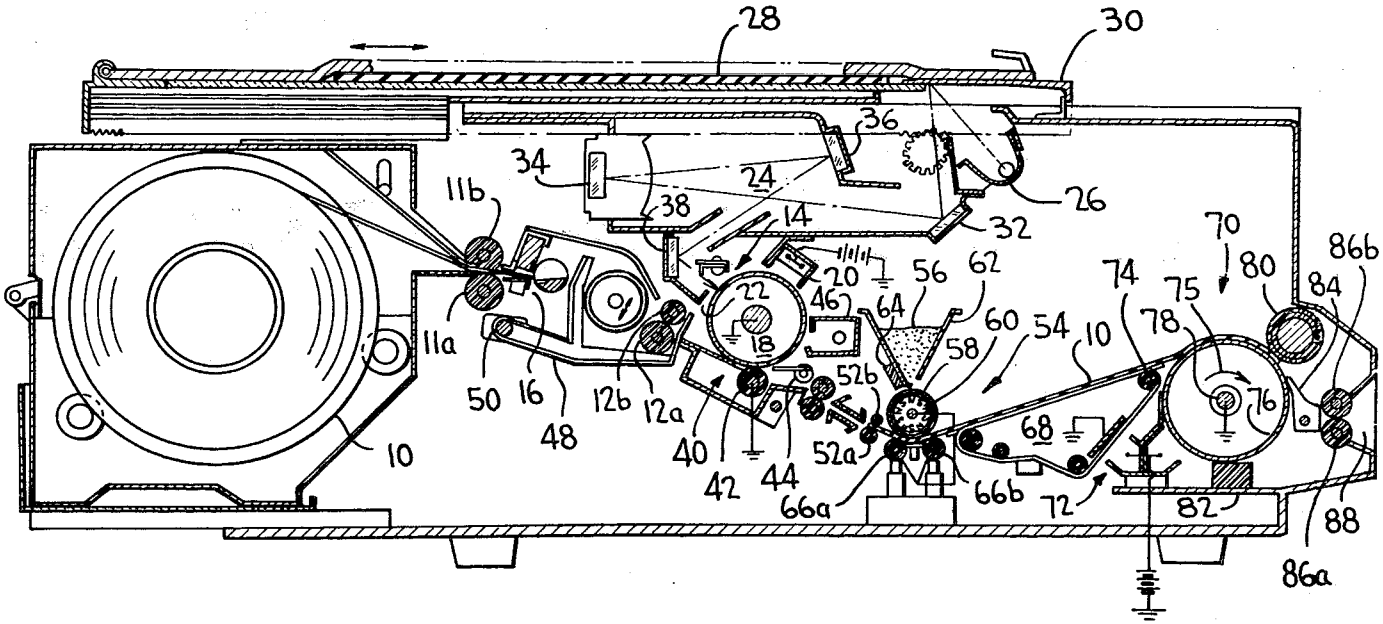
FIG. 4 is a longitudinal cross-sectional view of an electrostatic copying machine embodying the present invention.

In the electrostatic latent image transfer type copying machine of FIG. 4, there is used a copy sheet of paper 10 which has a thickness in the order of 90μ and a dielectric layer thickness in the order of 3μ, which are formed on a base sheet and subjected to electrically conductive treatment. The copy sheet 10 is electrostatically chargeable, for example, by using a layer of synthetic resins, such as acrylic resin or polyethylene. Copy paper is placed in the form of a roll in the copying machine and transported by a pair of paper feed rollers 11*a*, 11*b* and a pair of transporting rollers 12*a*, 12*b* to a succeeding electrostatic latent image forming station 14. The roll of copy paper is cut off by a cutter 16 when paid off in a length equal to that of an original document to be copied.

The electrostatic latent image forming station 14 is of an electrostatic latent image transfer type and comprises: a photoconductive drum 18 having a small diameter of 50 to 100 mm; a corona charger 20 for uniformly charging static electricity onto the surface of the photosensitive drum; and exposure station 22 for projecting an image of the original document onto the surface of photoconductive drum 18 by exposure device 24, thereby forming an electrostatic latent image on the drum surface. Exposure device 24 consists of: light source 26 for illuminating original document 28 stationarily placed on original document support 30 which is to be scanned at the peripheral speed of photoconductive drum 18; a mirror 32, mirror lens 34, mirrors 36 and 38; a transfer station 40 at which copy sheet 10 is brought into contact with the surface of photosensitive drum 18 under slight pressure by grounded, electrically conductive transfer roller 42. The electrostatic latent image formed on the surface of photoconductive drum 18 is transferred onto the surface of copy sheet 10 due to a gaseous discharge produced between the electrically conductive layers of photosensitive drum 18 and copy sheet 10 as a result of the formation of the electrostatic latent image on the drum surface. Transfer station 40 further includes separating pawl 44 for separating copy sheet 10 from the drum surface after the latent image has been transferred thereon; and eraser device 46 for erasing residual electrostatic charge from the surface of photoconductive drum 18. Exposure station 14, transfer station 40, separating pawl 44 and eraser device 46 are arranged in succession around photoconductive drum 18 within a confined space as shown in FIG. 4.

The reciprocating motion of original document support 30 is effected in response to movement of switch arm 48 of microswitch 50, which is actuated by copy sheet 10 after it has left cutter 16.

Copy sheet 10, which has passed electrostatic latent image forming station 14 is transported by a pair of transporting rollers 52*a* and 52*b* to a succeeding developing station 54. Developing station 54 uses a monocomponent toner 56 having magnetic and electroconductive properties, as is disclosed in U.S. Pat. No. 3,009,258. Electrically conductive sleeve 58 is mounted within magnetic roll 60, having alternately different polarities, and is disposed in a manner to rotate in a direction opposite to the advancing direction of copy sheet 10. Hopper 62, for supplying toner 56 onto the surface of conductive sleeve 58, gap adjusting plate 64, for limiting the length of toner chains which are to be formed by conductive sleeve 58 when toner is dropped through the bottom opening of hopper 62 onto the sleeve, and two of electrically conductive rollers 66*a*, 66*b*, positioned to transport copy sheet 10 and also to bring the transferred electrostatic latent image surface of the copy sheet into softly sliding contact with the toner chains on conductive sleeve 58, are provided around the periphery of conductive sleeve 58. Electrically conductive sleeve 58 and electrically conductive rollers 66*a*, 66*b* are electrically connected to each other but electrically insulated from the body proper of the copying machine. The relationship between conductive sleeve 58 and conductive rollers 66*a*, 66*b* will be described subsequently in conjunction with the description of FIG. 5.

Figure 5:
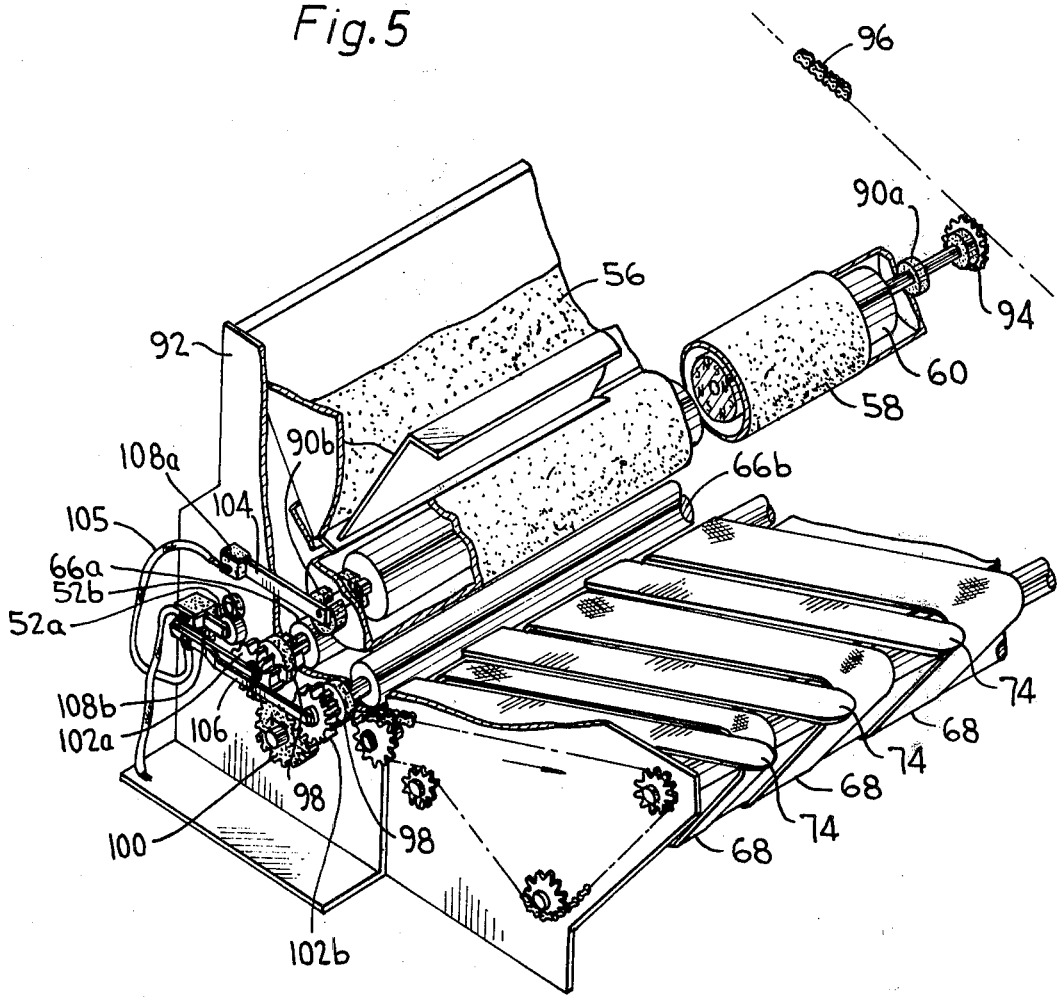
FIG. 5 is a perspective view of the developing portion of the copying machine of FIG. 4.

Toner 56, falling from hopper 62, is moved along the surface of conductive sleeve 58 in the direction opposite to the rotation of magnetic roll 60. When the aforementioned toner chains slidingly contact the surface of copy sheet 10, an electrically conductive path is formed through the toner chains between the electrostatic-latent-image-formed surface of copy sheet 10 and electrically conductive sleeve 58. If the potential difference between electrically conductive sleeve 58 and the image-formed area of the surface of copy sheet 10 is predominant over the magnetic attractive force (which is produced by magnetic roll 60 disposed within electrically conductive sleeve 58), then toner particles will be polarized by the electrically conductive path. The toner thus polarized will adhere to the surface of copy sheet 10 due to the polarized electrostatic charge, thereby making the latent image on copy sheet 10 visible. Copy sheet 10, having thereon the image developed in developing station 54, is electrostatically attracted to a plurality of transporting belts 68 for conveyance to succeeding fixing station 70. The plurality of parallel extending transporting belts 68 are uniformly charged with static electricity over the entire surface thereof to several thousand volts by corona charger 72. Copy sheet 10 thus attracted to transporting belts 68 is forcibly separated from the belt surfaces by means of a plurality of guide plates 74 disposed betwen the respective belt elements of the transporting belts, as best seen in FIG. 5. Each of the respective belt elements of transporting belts 68 may have a dielectric layer, such as Mylar, on its surface and an electrically conductive layer on its back side, with the electrically conductive layer grounded. As an alternative embodiment, a dielectric layer alone may be used, with the back side of each transporting belt grounded by a grounding plate in the vicinity of corona charger 72.

Fixing station 70 is of the heat roller type. Heat roller 75 in fixing station 70 comprises: heated drum 76, housing therein infrared heater 78, and having its peripheral outer surface coated with Teflon and its inner peripheral surface made of black colored aluminum, such as with carbon black, for better adsorption of radiant heat; and roller 80 disposed in pressure-contacting relation to heated drum 76 and made of an offset preventive material such as silicon rubber. The peripheral surface of heated drum 76 is uniformly charged to several thousand volts by corona charger 72 for charging electricity (as shown in FIG. 4, it also charges transporting belts 68 as well), so that copy sheet 10 entering fixing station 70 is electrostatically attracted to the peripheral surface of heated drum 76. As copy sheet 10 is heated from its back side, unfixed toner on copy sheet 10 is completely fixed due to the pressure of silicon roller 80. Cleaner 82 cleans the surface of heated drum 80.

After the toner is fixed, copy sheet 10 is separated from heated drum 76 by separating pawl 84 and delivered to the outside of the copying machine by a pair of rollers **86*a* and 86*b* disposed in the vicinity of delivery opening 88**.

As discussed above, one advantageous feature of the present invention is that at least the transporting path, such as the passage between electrostatic latent image forming station 14 and developing station 54 and the transporting path between developing station 54 and fixing station 70 are respectively shorter than the length of copy sheet 10.

Thus, in the copying machine according to the present invention, an electrostatic latent image corresponding to an image of the original document is formed on copy sheet 10 in electrostatic latent image forming station 14. The latent image thus formed is then developed into a visible image in developing station 54, and thereafter copy sheet 10 is electrostatically attracted to the surface of transporting belts 68 for positive transportation thereby, and is electrostatically attracted to the surface of heated drum 76 for positive adhesion thereto. In fixing station 70, heat from heated drum 76 is effectively conducted to copy sheet 10, thus achieving a rapid copying operation.

In FIG. 5 is a detailed perspective view of the transport passage between developing station 54 and fixing station 70 in the copying machine shown in FIG. 4. FIG. 5 also shows an example of the developing device in which the copy sheet remains free from stain or contamination, even after electrostatic attraction to the transporting means and conveyance to fixing station 70.

Electrically conductive sleeve 58 is attached by insulating members **90*a* and 90*b* to side plates 92 (only one shown) of the body proper of the copying machine. Magnetic roll 60 is arranged to be rotated by sprocket 94, made of an insulating material, and is driven by chain 96. Electrically conductive rollers 66*a*, 66*b* are journaled through insulating bearings 98 (only one shown) on side plates 92 of the body proper, in a manner so as to be rotated by the drive force of gear 100 which is made of an insulating material and meshes with gears 102*a*, 102*b*. Electrically conductive sleeve 58 and electrically conductive rollers 66*a*, 66*b*, constituting the developing electrodes, are respectively connected to electrode members 104, 106 with cord 105 interconnecting the electrode members such that electrode members 104, 106, conductive rollers 66*a*,66 *b* and conductive sleeve 58 are electrically isolated from side plates 92 of the copy machine by insulators 108*a*, 108*b***. The resistance of insulators used herein is preferably at least $10^{10}$ ohm.

Tests were taken of the developed latent image on copy sheet 10 in developing station 54, and a copy was obtained having an image with clear contrast, without any of the effects due to electrostatic adsorption of the copy sheet from the transporting means.

However, in the case where electrically conductive sleeve 58 and electrically conductive rollers **66*a*, 66*b* are grounded to the body proper of the copying machine, as in the case of the prior art, it was determined that, after the leading edge of copy sheet 10 has reached transporting belts 68 and is electrostatically attracted thereto, when the other remaining portion of copy sheet 10, which has not yet reached developing station 54, has passed through the developing station, toner adheres to the copy sheet and even on the areas thereof which are free of an image. This causes a uniform ground contamination on the surface of the copy sheet, and after the leading edge of copy sheet 10 has reached heated drum 76**, having thereon a potential of 1000 to 2000 volts and the copy sheet has been electrostatically attracted thereto, the tendency of toner adhering uniformly to the surface of the copy sheet is further increased, resulting in uniform ground contamination on the copy sheet in which the toner density thereof is in the order of 0.3 (which corresponds to the potential of about 20 volts). Such ground contamination with prior art copying apparatus was discussed above.

According to the present invention, with electrically conductive roller 42, for transferring the latent image from photoconductive drum 18 in FIG. 4 connected to a bias potential source, to facilitate the transfer of an electrostatic latent image to copy sheet 10, there was obtained a copy having an image with a clear contrast, without the influence due to the bias potential source as in the prior art apparatus.

According to the present invention, with the transporting passage between the heat roller and the developing station in the copying machine of FIG. 4 extremely shortened, transporting belts 68 need not necessarily be of the electrostatic adsorption type, but heated drum 76 alone may be of the electrostatic attracting type. Alternatively, the heated drum itself may be made of metal and driven by an electrically conductive belt coated with Teflon, so that the electrically conductive belt may provide electrostatic attraction for transportation of the copy sheet. The latter embodiment is more preferable from the viewpoint of reducing the size of the copying machine and speeding-up the copying operation.

The above description of FIG. 4 is with respect to electrostatic latent image transfer type copying machines. The objects and advantages of the present invention may also be obtained in direct type electrostatic copying machines which are a modification of the copying machine shown in FIG. 4. In the direct type electrostatic copying machine, a copy sheet is used having a photoconductive layer such as zinc oxide overlaying a support sheet subjected to an electroconductive treatment. Further, electrostatic latent image forming station 14 may use charging and exposure devices forming an electrostatic latent image directly on copy sheet 10.

In the embodiment described herein, the developing system disclosed in U.s Pat. No. 3,909,258 is used. Other known developing electrode systems, such as a magnetic brush developing system using a two-component developer consisting of a toner and a carrier, may also meet the objects of the present invention, if it is used in accordance with the techniques described with respect to FIG. 4.

What is claimed is:

1. In an electrostatic copying machine using a copy sheet having a dielectric layer or photoconductive layer formed on an electrically-conductive layer, means for forming an electrostatic latent image on said copy sheet, developing electrode means including a developing electrode and opposing electrode mounted in spaced relationship enabling passage of said copy sheet therebetween for developing said electrostatic latent image on said copy sheet into a toner image, means for fixing said toner image on said copy sheet, transporting means for conveying said copy sheet and positioned between said developing means and said fixing means, a first transporting passage between said image forming means and said developing means and a second transporting passage between said developing means and said fixing means, said first and second transporting passages being respectively shorter than the length of said copy sheet; and said electrically conductive layer of said copy sheet having a charge potential thereon;

wherein the improvement comprises:

means for electrically connecting said developing electrode and said opposing electrode directly to each other and means for separately electrically insulating said developing electrode and said opposing electrode from grounding means including the body proper of said copying machine.

2. An electrostatic copying machine as in claim 1, wherein said copy sheet transporting means includes an endless transport member and a corona charger for uniformly charging said endless transport member, whereby said copy sheet is electrostatically attracted thereto.

3. An electrostatic copying machine as in claim 1, wherein said fixing means includes a heated drum and a corona charger for uniformly charging the surface of said heated drum, whereby said copy sheet is electrostatically attracted thereto.

4. An electrostatic copying machine as in claim 3, wherein said copy sheet transporting means includes an endless transport member and a corona charger for uniformly charging said endless transport member, whereby said copy sheet is electrostatically attracted thereto.

5. An electrostatic copying machine as in claim 1, wherein said means for electrically connecting includes an electrical line interconnecting said developing electrode and said opposing electrode and wherein the resistance of said means for separately insulating is at least greater than $10^{10}$ ohm.

6. In an electrostatic copying machine using a copy sheet having a dielectric layer or photoconductive layer formed on an electrically-conductive layer, means for forming an electrostatic latent image on said copy sheet, developing electrode means including a developing electrode and opposing electrode mounted in spaced relationship enabling passage of said copy sheet therebetween for developing said electrostatic latent image on said copy sheet into a toner image using a mono-component toner having electroconductive properties, means for fixing said toner image on said copy sheet, transporting means for conveying said copy sheet and positioned between said developing means and said fixing means, a first transporting passage between said image forming means and said developing means and a second transporting passage between said developing means and said fixing means, said first and second transporting passages being respectively shorter than the length of said copy sheet;

said electrically conductive layer of said copy sheet having a charge potential thereon;

wherein the improvement comprises:

means for electrically connecting said developing electrode and said opposing electrode directly to each other and means for separately electrically insulating said developing electrode and said opposing electrode from grounding means including the body proper of said copying machine.

7. An electrostatic copying machine as in claim 6, wherein said means for electrically connecting comprises an electrical line interconnecting said developing electrode and said opposing electrode and wherein the resistance of said means for separately insulating is at least greater than $10^{10}$ ohm.

8. an electrostatic copying machine as in claim 6, wherein said mono-component toner has magnetic properties and said developing electrode includes an electrically conductive sleeve for retaining toner on the surface thereof and including therein a magnetic roll having alternately different polarities; and said opposing electrode includes an electrically conductive device for transporting and positioning the copy sheet to bring said electrostatic latent image surface thereof into sliding contact with said toner on said sleeve.

9. An electrostatic copying machine as in claim 8 wherein said transporting means includes a plurality of spaced endless belts and a guide plate separating adjacent ones of said endless belts, said means for fixing including a heated drum and a corona charger for uniformly charging the surface of said heated drum, the ends of said guide plates extending adjacent the surface of said heated drum.

10. An electrostatic copying machine as in claim 8, wherein said copy sheet transporting means includes an endless transport member and a corona charge for uniformly charging said endless transport member, whereby said copy sheet is electrostatically attracted thereto.

11. An electrostatic copying machine as in claim 8, wherein said fixing means includes a heated drum and a corona charger for uniformly charging the surface of said heated drum, whereby said copy sheet is electrostatically attracted thereto.

12. An electrostatic copying machine as in claim 11, wherein said copy sheet transporting means includes an endless transport member and a corona charger for uniformly charging said endless transport member, whereby said copy sheet is electrostatically attracted thereto.

13. An electrostatic copying machine as in claim 8 wherein said electrically conductive device includes a pair of rollers spaced from said electrically conductive sleeve and forming an arcuate transporting passage therewith.

14. An electrostatic copying machine as in claim 13 wherein said means for electrically insulating includes insulating members for mounting said electrically conductive sleeve to the body of said copying machine and insulating bearings for supporting each of said pair of rollers in the body of the copying machine, said means for electrically connecting includes electrode members mounted to the body of the copying machine and electrical conductors for connecting said conductive sleeve and each of said rollers to said electrode members, and said means for electrically insulating further including insulators for electrically insulating said electrode members from the body proper of said copying machine.

15. An electrostatic copying machine as in claim 14 further comprising means for rotating said electrically conductive sleeve and said pair of rollers and including an insulated drive sprocket mounted on a shaft including said electrically conductive sleeve, each of the rollers including a gear mounted at one end thereof and said means for rotating further including an intermediary gear mounted to said shaft and meshing with each of the roller gears.

* * * * *